US007578401B2

(12) United States Patent
Schnitzer

(10) Patent No.: US 7,578,401 B2
(45) Date of Patent: Aug. 25, 2009

(54) SINK RACK

(76) Inventor: Brant Andrew Schnitzer, 140 Kerby Mainline Rd., Kerby, OR (US) 97531

( * ) Notice: Subject to any disclaimer, the term of this patent is extended or adjusted under 35 U.S.C. 154(b) by 0 days.

(21) Appl. No.: 11/372,413

(22) Filed: Mar. 10, 2006

(65) Prior Publication Data

US 2007/0210019 A1 Sep. 13, 2007

(51) Int. Cl.
*A47G 19/08* (2006.01)

(52) U.S. Cl. ..... 211/41.6; 211/200

(58) Field of Classification Search ..... 211/41.5, 211/41.6, 41.2, 195, 200, 85, 198, 85.25; D32/3, 55–59; 220/572, 487, 488
See application file for complete search history.

(56) References Cited

U.S. PATENT DOCUMENTS

| | | | | | |
|---|---|---|---|---|---|
| 53,055 | A * | 3/1866 | Stone et al. | ..... | 211/198 |
| 222,542 | A * | 12/1879 | Stearns | ..... | 211/200 |
| 329,150 | A * | 10/1885 | Eaton | ..... | 211/200 |
| 395,393 | A * | 1/1889 | Holzmerk | ..... | 134/85 |
| 415,634 | A * | 11/1889 | Guptill | ..... | 211/41.4 |
| 542,784 | A * | 7/1895 | Johnson | ..... | 281/33 |
| 1,971,523 | A * | 8/1934 | Feingold | ..... | 211/41.5 |
| 2,562,982 | A * | 8/1951 | Cieri | ..... | 211/41.6 |
| 2,958,424 | A * | 11/1960 | Bigatti | ..... | 211/41.5 |
| 4,212,400 | A * | 7/1980 | Buchsteiner | ..... | 211/41.6 |
| 4,221,299 | A * | 9/1980 | Taylor | ..... | 211/41.6 |
| 4,328,899 | A * | 5/1982 | Krusche | ..... | 211/41.6 |
| 5,012,934 | A * | 5/1991 | Newhall | ..... | 211/41.3 |
| 6,357,605 | B1 * | 3/2002 | Martorella | ..... | 211/41.6 |
| 6,513,674 | B1 * | 2/2003 | Kajikawa et al. | ..... | 220/572 |
| 6,516,956 | B2 * | 2/2003 | Martorella et al. | ..... | 211/41.6 |
| 2004/0099617 | A1 * | 5/2004 | Elias et al. | ..... | 211/41.3 |
| 2004/0138063 | A1 * | 7/2004 | Mito | ..... | 504/168 |
| 2006/0289372 | A1 * | 12/2006 | Yang et al. | ..... | 211/41.3 |

* cited by examiner

*Primary Examiner*—Jennifer E. Novosad

(57) ABSTRACT

A drain rack for countertop mounted sinks that extends over the width of the sink, is foldable in scissor fashion, includes notches for holding small dishes as well as bars for standard sizes, and netting for utensils.

7 Claims, 2 Drawing Sheets

SINK RACK

BACKGROUND

The device disclosed herein relates generally to devices for draining items and more specifically to devices for draining items over a sink. The over the sink dish rack overcomes problems of conventional dish drainers such as those that include a basket for draining dishes. These types of drainers take up too much counter space, or half or all of a sink and restrict the rinse area between the basket and the faucet.

SUMMARY

Disclosed herein is a rack that fits over the sink and that incorporates receptacles for the articles to be drained all into a folding unit. The draining system disclosed herein incorporates a dish drying rack, glass and cup holders, and utensil holder drying net. It is designed for installation over the sink or sinks in the unused area directly above the faucet. The dish drainer spans the width of the entire sink or sinks and folds up for easy transport or storage. The over the sink rack can dry the dishes faster due to increased air movement compared to in sink baskets and drain mat that can create slime, mold and bacteria.

DRAWINGS

DESCRIPTION OF EMBODIMENT

Figure 1:
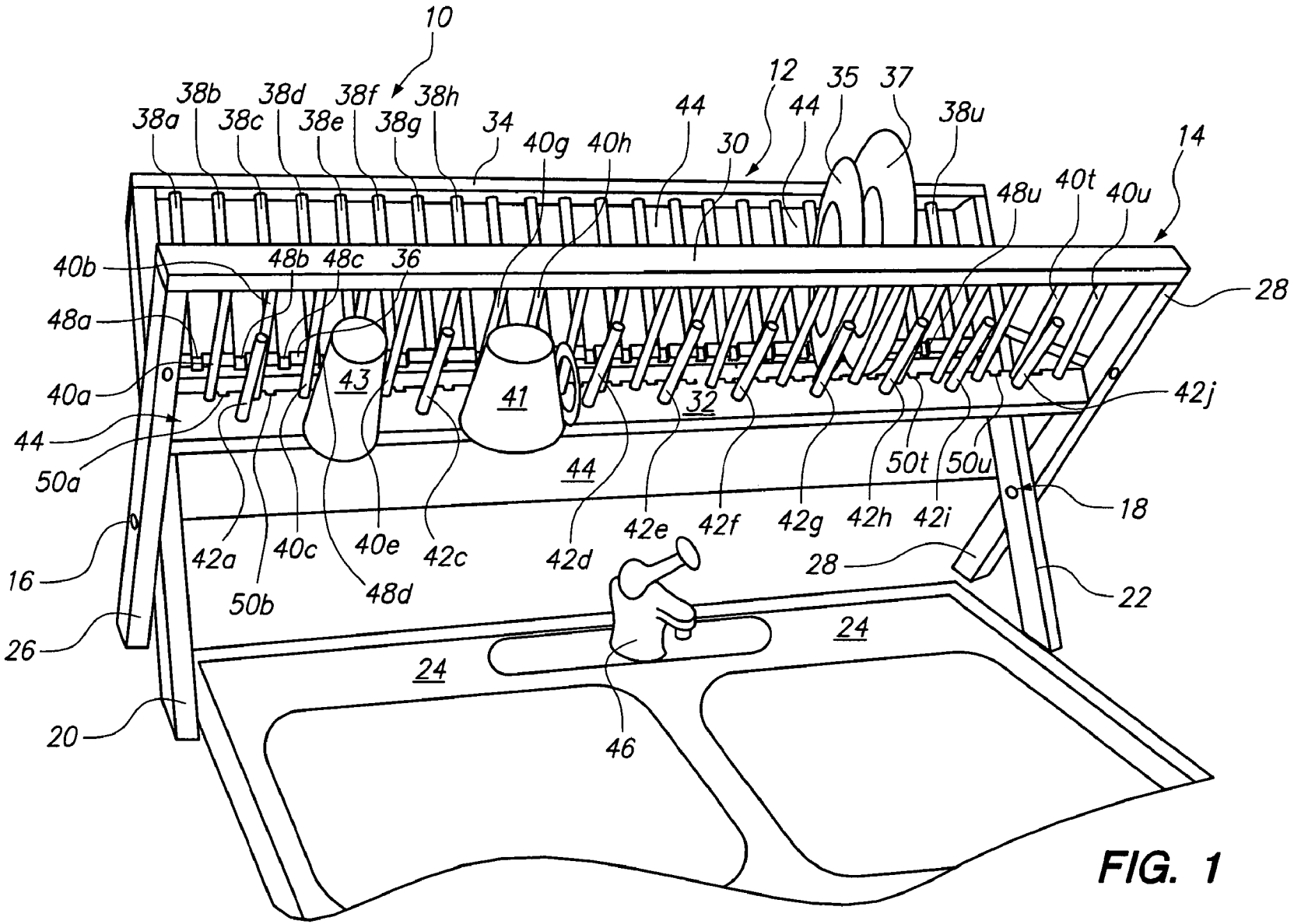
FIG. 1 is a perspective front view showing the article of manufacture described herein.

FIG. 1 shows an over the sink, folding drain rack 10 including two frame members 12 and 14. They are joined together by pins 16 and 18 to thereby enable the folding of the two frames together, in scissor fashion, for transport or storage.

In FIG. 1 the end support base members 20 and 22 of the narrower rear frame 12 have a distance between them sufficient to span the entire sink or dual counter top mounted sinks 24. Similarly, end support base members 26 and 28 of wider front frame 14 also extend beyond the width of the counter top mounted sink 24.

In FIG. 1 the two frame members 26 and 28 are coupled together by upper and lower horizontal members 30 and 32. Similarly, base support members 20 and 22 are secured together by upper and lower horizontal members 34 and 36.

In between the two horizontal bars 34 and 36 of frame 12, there are arranged a series of vertical rods, selective ones of which have been numbered as 38*a*, 38*b*, 38*c*, 38*d*, 38*e*, 38*f*, 38*g*, 38*h*, and 38*u*. Similarly, in between horizontal bars 30 and 32 of frame 14, there are arranged a series of vertical rods, selective ones of which have been numbered as 40*a*, 40*b*, 40*c*, 40*e*, 40*g*, 40*h*, 40*t*, and 40*u*. These two series of vertical rods hold medium and large plates such as 35 and 37 erect and apart from each other for draining.

Also shown in FIG. 1 are a series of short rods, selective ones of which have been numbered 42*a*, 42*c*, 42*d*, 42*e*, 42*f*, 42*g*, 42*h*, 42*i*, and 42*j*. These short rods 42*a* through 42*i* are shown attached to the topside of horizontal bar 32. As seen in FIG. 1 they are used to drain and dry items such as a cup 41 or glass 43.

Splash guard 44 is fastened to the back of rear frame 12. As can be seen in FIG. 1, it guides the drained water to flow directly into the sink instead of to the back of it. The bottom of the splash guard 44 is sufficiently high to clear and permit normal function of a faucet 46.

To also keep plates erect and in place, between the corresponding rods 38*a* and 40*a*, 38*b* and 40*b*, etc, there is fabricated a series of notches, selective ones of which have been numbered 48*a*, 48*b*, 48*c*, and 48*u* in the bottom 36 of frame member 12. Similarly there is fabricated a series of notches, selective ones of which have been numbered 50*a*, 50*b*, 50*c*, 50*t* and 50*u* in the bottom 32 of frame member 14 (see also FIG. 2).

Referring again to FIG. 2 net 52 is provided for receiving and draining utensils. Utensil net 52 is fastened in between the bottoms of the two lower horizontal bars 32 and 36. The horizontal bars 32 and 36 are positioned so as not to interfere with the operation of faucet 46.

Figure 2:
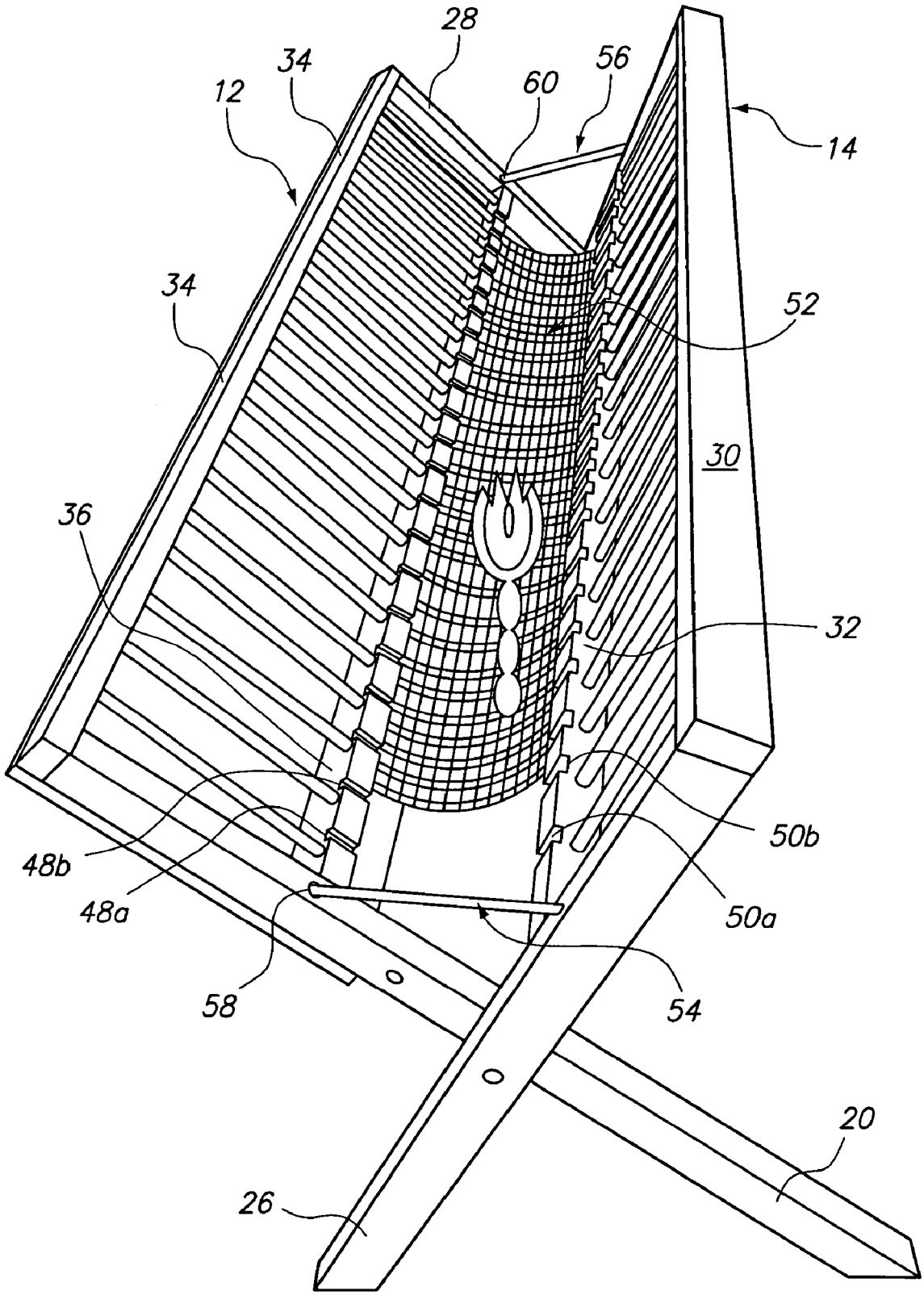
FIG. 2 is a perspective end view of the sink rack of the article of manufacture described herein showing the utensil net of the device disclosed and the suspension members for maintaining the device in its open position.

To prevent the over sink drainer from collapsing under the weight of draining kitchenware, suspension ropes 54 and 56 are attached between the two crossed end support pieces 16 and 20 on one end and between 22 and 28 at the other end. They may be attached through bore holes such as 58 and 60 in members 20 and 28, respectively as illustrated in FIG. 2.

What I claim is:

1. A rack for draining items over a counter top mounted sink comprising:

a frame having first and second frame members pivotal about an axis of rotation to thereby enable opening and closing of said frame in scissor fashion, said first frame member having a first and a second base member connected by first and second linking members;

said second frame member having a third and a fourth base member connected by third and fourth linking members;

the distance between said first and second base members and the distance between said third and fourth base members being greater than the width of said counter top mounted sink so as to enable said rack for draining items to be positioned over said sink;

a first plurality of substantially parallel bars positioned in said first frame member and a second plurality of substantially parallel bars positioned in said second frame member;

said first and second plurality of parallel bars being positioned with respect to each other so as to receive and hold articles for draining;

there being a gap between said second linking member and said fourth linking member; and a drying net being positioned in said gap.

2. The rack of claim 1 further comprising:

a plurality of means for holding plates relatively upright formed in said first and second frame members in between respective ones of said first and second pluralities of substantially parallel bars.

3. The rack of claim 2 wherein each of said plurality of means comprises a notch.

4. The rack of claim 1 wherein said rack is for draining items over said counter top mounted sink including a faucet; and wherein said second linking member is connected to said first and second base members and said fourth linking member is connected to said third and fourth base members respectively so as to be positioned sufficiently distant from said faucet, and there is substantial open space between said first and second base members and between said third and fourth base members so as to permit function of said faucet when said rack is placed over said counter top mounted sink.

5. A rack for draining items over a counter top-mounted sink said rack having a normal upright position, comprising:

a frame having first and second frame members both being pivotal about an axis of rotation to thereby enable opening and closing of said frame in scissor fashion, said first frame member having a first and a second base member connected by first and second linking members, said second linking member being disposed below said first linking member when said rack is in said upright position;

said second frame member having a third and a fourth base member connected by third and fourth linking members, said fourth linking member being disposed below said third linking member when said rack is in said upright position;

a first plurality of substantially parallel bars positioned in said first frame member and a second plurality of substantially parallel bars positioned in said second frame member;

said first and second plurality of parallel bars being positioned with respect to each other so as to receive and hold articles for draining;

there being a gap between said second linking member and said fourth linking member; and a drying net being positioned in said gap.

6. The rack of claim 5 further comprising:

a plurality of means for holding plates relatively upright formed in said first and second frame members in between respective ones of said first and second pluralities of substantially parallel bars.

7. The rack of claim 6 wherein each of said plurality of means comprises a notch.

* * * * *